US008878425B2

(12) United States Patent
Burmenko

(10) Patent No.: US 8,878,425 B2
(45) Date of Patent: Nov. 4, 2014

(54) SPARK PLUG

(76) Inventor: Oleksandr Burmenko, Toronto (CA)

( * ) Notice: Subject to any disclaimer, the term of this patent is extended or adjusted under 35 U.S.C. 154(b) by 20 days.

(21) Appl. No.: 13/811,509

(22) PCT Filed: Jul. 21, 2011

(86) PCT No.: PCT/CA2011/000842

§ 371 (c)(1),
(2), (4) Date: Mar. 29, 2013

(87) PCT Pub. No.: WO2012/009800

PCT Pub. Date: Jan. 26, 2012

(65) Prior Publication Data

US 2013/0221830 A1 Aug. 29, 2013

Related U.S. Application Data

(60) Provisional application No. 61/366,752, filed on Jul. 22, 2010, provisional application No. 61/366,969, filed on Jul. 23, 2010.

(51) Int. Cl.

| | |
|---|---|
| ***H01T 13/20*** | (2006.01) |
| ***H01T 13/02*** | (2006.01) |
| ***H01T 13/54*** | (2006.01) |

(52) U.S. Cl.

CPC ..... *H01T 13/02* (2013.01); *H01T 13/54* (2013.01)

USPC ..... 313/143; 313/140

(58) Field of Classification Search

CPC ..... H01T 13/32; H01T 13/54

USPC ..... 313/118–145

See application file for complete search history.

(56) References Cited

U.S. PATENT DOCUMENTS

| | | | | |
|---|---|---|---|---|
| 2,702,537 | A | 2/1955 | Wright et al. | |
| 3,710,772 | A | 1/1973 | Warner | |
| 2007/0022736 | A1 | 2/2007 | Durling et al. | |
| 2009/0309475 | A1 * | 12/2009 | Tozzi | 313/143 |

* cited by examiner

*Primary Examiner* — Anne Hines

(74) *Attorney, Agent, or Firm* — Gifford, Krass, Sprinkle, Anderson & Citkowski, P.C.

(57) ABSTRACT

Disclosed is an improved spark plug having an electrode extending from an insulator tip into a piston chamber in use. The improvement comprises a shell defining: a cavity; a cavity opening which couples the cavity with said piston chamber in use; a conduit extending from the cavity and into which the electrode extends in spaced relation to the shell; and, with the tip, a chamber surrounding the tip in spaced relation and coupled to the cavity by the conduit. The cavity includes: a concave portion presenting towards the opening such that the cavity narrows as it extends towards the conduit; and a cylindrical portion extending from the concave portion towards the opening. The chamber includes a cylindrical portion surrounding the tip in spaced relation and a frustoconical portion coupling the cylindrical portion to the conduit such that the chamber narrows as it extends from its cylindrical portion to the conduit.

11 Claims, 3 Drawing Sheets

SPARK PLUG

CROSS-REFERENCE TO RELATED APPLICATIONS

This application is the U.S. National Phase of PCT/CA2011/000842 filed Jul. 21, 2011, which claims priority of U.S. Provisional Applications 61/366,752 filed Jul. 22, 2010 and 61/366,969 filed Jul. 23, 2010.

FIELD OF THE INVENTION

The present invention relates to the field of internal combustion engines.

BACKGROUND TO THE INVENTION

It is well known to use a spark plug to ignite an air and fuel mixture in a combustion chamber in a spark ignition engine.

The performance of the spark plug can directly affect engine performance; if the spark plug does not properly ignite the air and fuel mixture in the combustion chamber, there will be fuel at least partially unburned, leading to a loss of power, reduced fuel efficiency and increased hydrocarbon emissions.

Given the extreme conditions under which a typical spark plug operates, and given that a typical spark plug fires many times before replacement, deterioration is inevitable; this often manifests as deposits on the electrodes, and also manifests as erosion of the electrodes.

Various innovations have been proposed to reduce deterioration.

Many innovations have been focused towards the issue of electrode erosion: toughening the material from which the electrodes are manufactured or increasing the number of electrodes.

Another innovation is the surface discharge spark plug. In a surface discharge spark plug, the metallic outer shell of the spark plug presents an annular ground electrode disposed coaxially with a central positive electrode.

Specific innovations to the construction of the annular grounding electrode have also been proposed. It is known, for example, to provide open ended slots, backward spaced slots and/or holes defined by the annual grounding electrode. Each of these techniques incorporates a complicated re-design of a conventional spark plug that could result in significantly higher manufacturing costs.

SUMMARY OF THE INVENTION

Forming one aspect of the invention is a spark plug. This spark plug comprises: an insulator; a central electrode extending through the insulator and having an ignition end; an outer shell having a conducting end disposed about the insulator and a grounding electrode end proximate to the ignition end of the central electrode; and a cavity defined by the grounding electrode end of the outer shell and extending into a cylinder head to which the spark plug is attachable.

According to another aspect, the spark plug can further comprise an annular ledge in the outer shell.

According to another aspect, the spark plug can further comprise a chamber defined by the conducting end of the outer shell.

According to another aspect, a portion of the insulator can project into the chamber.

According to another aspect, a conduit can be defined by the annular ledge wherein the conduit is orientated such that the cavity is in communication with the chamber.

According to another aspect, the ignition end of the central electrode can be orientated in the conduit.

According to another aspect, the grounding electrode end of the outer shell can be cylindrical and the cavity can be constituted by a circular section.

According to another aspect, an inner wall of the cavity can be sloped such that the cavity is bowl-shaped.

According to another aspect, the conduit can be orientated at the base of the inner wall.

According to another aspect, the spark plug can further comprising a continuous thread in an outer wall of the grounding electrode end of the outer shell.

An improved spark plug forms another aspect of the invention. The improved plug is of the type including a center electrode extending from an insulator tip and which extends into a piston chamber in use. The improvement comprising a shell. The shell: defines a cavity; defines a cavity opening which couples the cavity with said piston chamber in use; defines a conduit extending from the cavity and into which the electrode extends in spaced relation to the shell; and in combination with the insulator tip, defines a chamber surrounding the insulator tip in spaced relation and coupled to the cavity by the conduit.

According to another aspect, the cavity can narrow as the cavity extends towards the conduit.

According to another aspect, the cavity can include a concave portion presenting towards the cavity opening such that the cavity narrows as the cavity extends towards the conduit.

According to another aspect, the cavity can include a substantially cylindrical portion extending from the concave portion towards the cavity opening.

According to another aspect, the cavity opening can be frustoconical and flare outwardly as the cavity opening extends from the substantially cylindrical portion.

According to another aspect, the cavity opening can be frustoconical and flare inwardly as the cavity opening extends from the substantially cylindrical portion.

According to another aspect, the shell can have a frustoconical outer surface and the frustoconical outer surface of the shell and the cavity opening can intersect in a knife-like edge.

According to another aspect, the chamber can include a substantially cylindrical portion surrounding the insulator tip in spaced relation and the chamber narrows as the chamber extends from the cylindrical portion thereof to the conduit.

According to another aspect, the chamber can include a substantially cylindrical portion surrounding the insulator tip in spaced relation and a frustoconical portion coupling the substantially cylindrical portion to the conduit such that the chamber narrows as the chamber extends from the cylindrical portion thereof to the conduit.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter being briefly described hereinafter.

BRIEF DESCRIPTION OF THE DRAWINGS

The embodiments of the present invention will now be described by reference to the following figures, in which identical reference numerals in different figures indicate identical elements and in which.

DETAILED DESCRIPTION

Figure 1:
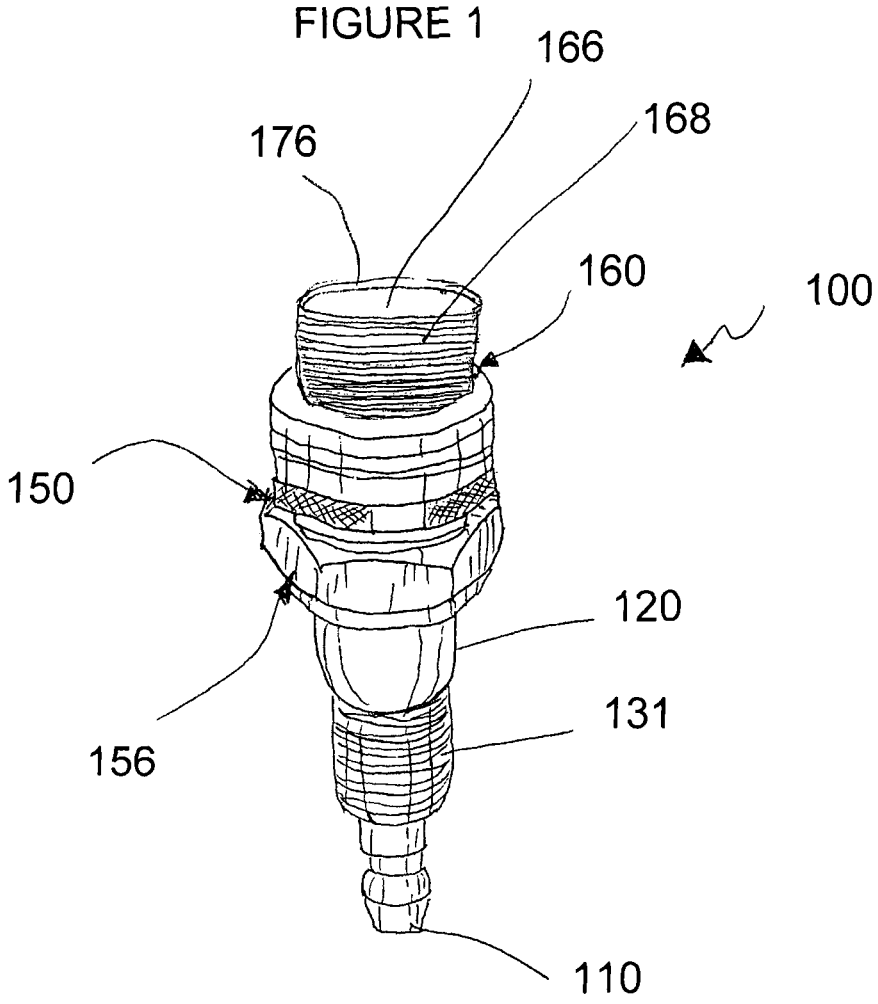
FIG. 1 shows a perspective view of the spark plug according to an exemplary embodiment of the present invention.

Referring first to FIG. 1, there is shown in perspective view an exemplary embodiment of a spark plug 100 according to the present invention. As with conventional spark plugs, the spark plug 100 is for use with a cylinder head (not shown) of an internal combustion engine (not shown).

The spark plug 100 has a terminal 110 adapted for connection to the ignition system (not shown) of a vehicle (not shown) in a conventional manner.

Figure 2:
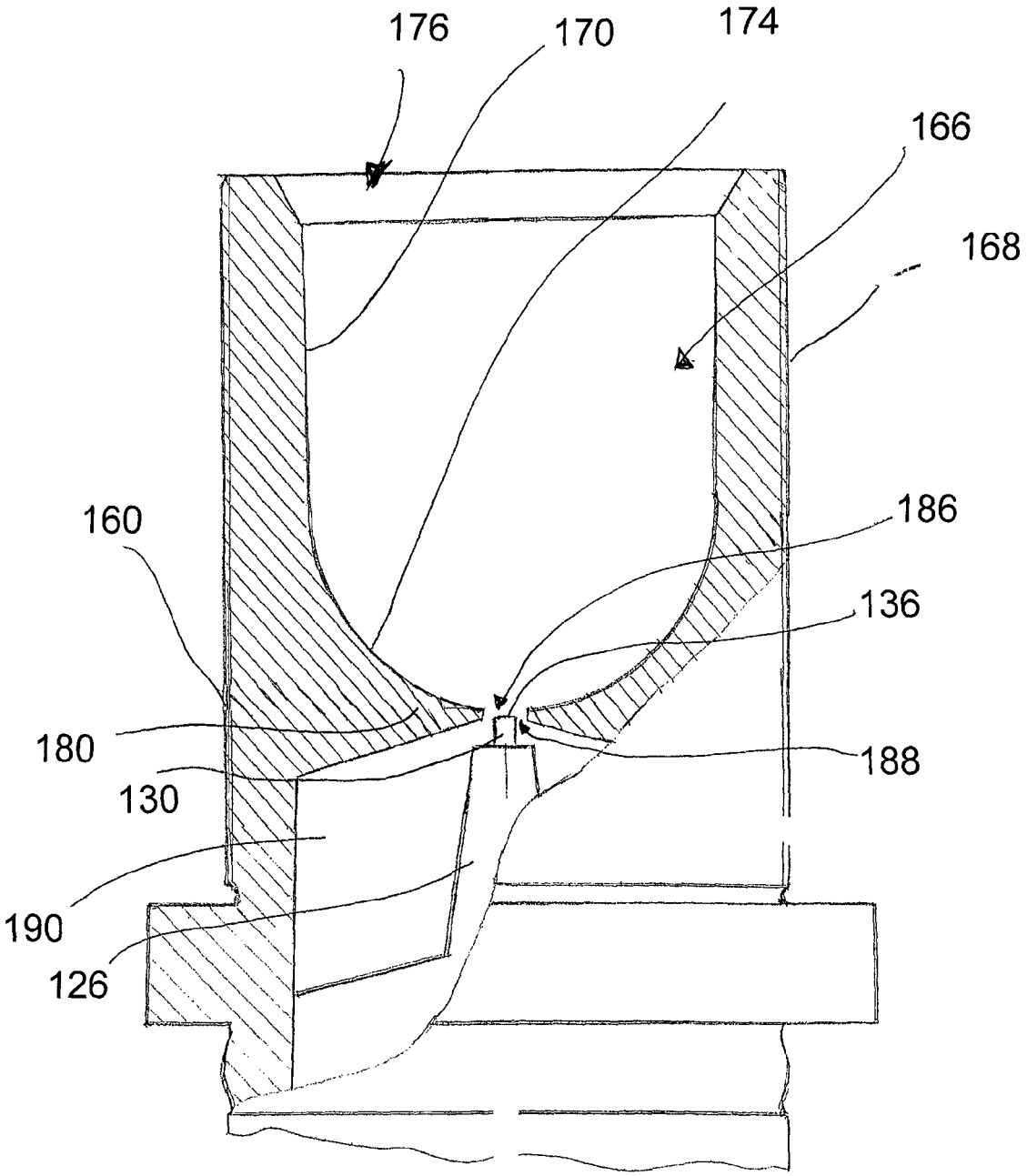
FIG. 2 shows a partial sectional view of the spark plug of the present invention.

The spark plug 100 also has an insulator 120. It will be appreciated by persons skilled in the art that the insulator 120 is constructed from a material with high heat conductivity, namely, porcelain. The insulator 120 incorporates ribs 131 and, as seen in FIG. 2, terminates in an insulator tip 126. The insulator tip 126 is tapered and is manufactured from material providing high thermal conductivity, namely, sintered aluminium oxide ceramic.

A central electrode 130 extends through the insulator 120 and insulator tip 126 to terminate in a protruding ignition end 136. The central electrode 130 is: metallic, namely, a nickel alloy including copper and chromium; elongate; and cylindrically-shaped.

The foregoing elements are substantially conventional and are shaped, constructed and dimensioned in a manner similar to corresponding elements of conventional spark plugs of the prior art.

Returning again to the figures, the spark plug 100 will be seen to have a steel outer shell 150. The outer shell 150 has a hexagon end 156 disposed about the insulator 120 and a grounding electrode end 160 that is provided with a thread 168. The hexagon end 156 is adapted to be driven by a socket wrench in the conventional manner. The grounding electrode end 160 of the outer shell 150 is adapted to engage the engine block by the thread 168 in a conventional manner.

The outer shell 150: defines a cavity 166; defines a frustoconical cavity opening 176 which couples cavity 166 with the piston chamber (not shown) in use; defines a conduit 186 extending from the cavity 166 and into which the ignition end 136 extends; and, in combination with insulator tip 126, defines a chamber 190 surrounding the insulator tip 126 and coupled to cavity 166 by conduit 186.

Cavity 166 is bounded by a cylindrical inner wall 170 which extends from the cavity opening 176 and a concave base wall 174 that extends between inner wall 170 and conduit 186.

Chamber 190 includes a substantially cylindrical portion surrounding and coaxial with the electrode 130 and a frustoconical portion that extends between the cylindrical portion and the conduit 186, such that outer shell 150 defines an annular ledge 180 surrounding and projecting towards conduit 186.

The annular ledge 180 terminates in spaced relation from the ignition end 136 of the central electrode 130 to define an annular gap 188.

Without intending to be bound by theory, in use, it is believed that the annular ledge 180 acts in a manner similar to a conventional spark plug ground electrode, and that the fuel-air mixture is compressed into and combusted in cavity 166, chamber 190 and conduit 186.

Figure 3:
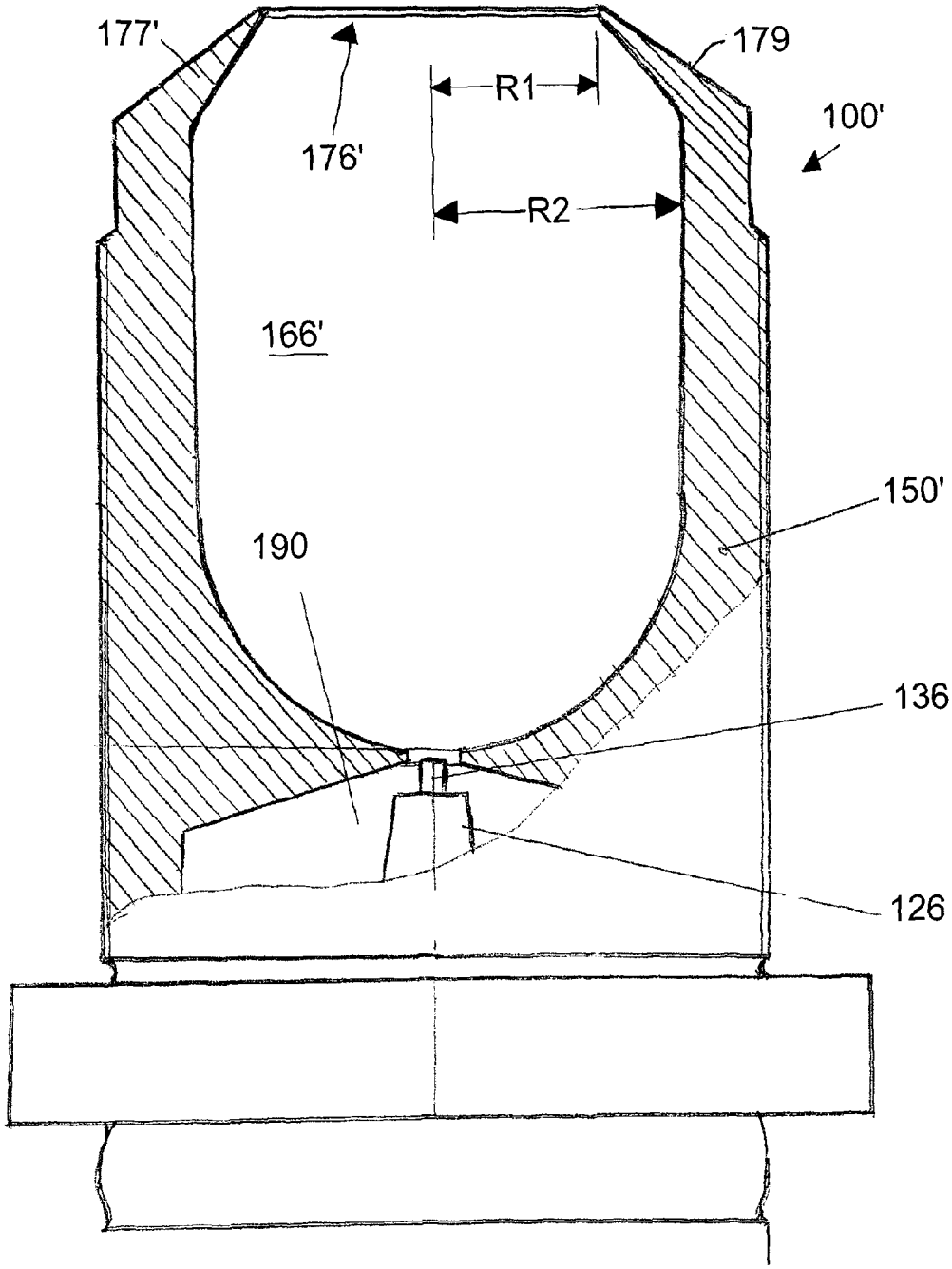
FIG. 3 shows a view, similar to FIG. 2, of a spark plug according to another exemplary embodiment of the present invention.

FIG. 3 shows another exemplary embodiment of the invention. This Figure shows a spark plug 100' that is substantially identical in structure to spark plug 100 of FIG. 2, differing only in the presence of a modified cavity opening 176' defined by an annular lip 177' partially occluding access to cavity 166' such that the inlet area of cavity opening 176' is 60% of the cross-sectional area of cavity 166' [R1:R2≈13:19]. Frustoconical outer surface 179 of modified shell 150' intersects with cavity opening 176' in a knife-like edge.

Tests conducted upon vehicles incorporating the spark plugs of the present invention confirmed their ability to improve performance, as evidenced below. In the tabulated examples below, the plugs are designated as follows:

| | |
|---|---|
| stock | a new plug of a type recommended by the manufacturer for the test vehicle |
| 100% | a plug of the stock type but modified according to the invention as per FIG. 2 [R1 = R2] |
| 75% | a plug of the stock type but modified according to the invention such that the inlet area is 75% of the cross-sectional area of the cavity [R1:R2 = 86:100]] |
| 50% | a plug of the stock type but modified according to the invention such that the inlet area is 50% of the cross-sectional area of the cavity [R1:R2 = 71:100] |
| 25% | a plug of the stock type but modified according to the invention such that the inlet area is 25% of the cross-sectional area of the cavity [R1:R2 = 50:100] |

and the test vehicles are defined as follows:

| | |
|---|---|
| FORD | 2011 Ford Escape<br>4 cylinder gas engine<br>2.5 liter displacement |
| LADA | 2011 Chevy Niva<br>4 cylinder gas engine<br>1.7 liter displacement |
| HEMI | 2006 Dodge Ram<br>8 cylinder gas engine<br>5.7 liter HEMI |

| Example | Test Vehicle | Plug | Results |
|---|---|---|---|
| 1 | FORD | Stock | Mileage: 12 liters/100 km (city) |
| 2 | FORD | 75% | Mileage: 10 liters/100 km (city)<br>Perception of better power than Example 1 but engine stalled during operation |
| 3 | FORD | 100% | Mileage: 10 liters/100 km (city)<br>Perception of better power than Example 1, engine was smooth running |
| 4 | LADA | Stock | Mileage: 12 liters/100 km (city) |
| 5 | LADA | 50% | Mileage: 11 liters/100 km (city)<br>Perception of better power than Example 4 but engine unsteady |
| 6 | LADA | 100% | Mileage: 10 liters/100 km (city)<br>Perception of better power than Example 4, engine was smooth running |
| 7 | HEMI | Stock | Mileage: 20 liters/100 km (city) |
| 8 | HEMI | 100% | Mileage: 21 liters/100 km (city)<br>Perception of better power than Example 7 |
| 9 | HEMI | 25% | Mileage: 15 liters/100 km (city)<br>Perception of better power than Example 7 |

Testing has also confirmed improvements in emissions.

EXAMPLE

A 1995 Chevrolet Cavalier, with a recently tuned 2.2 liter gasoline engine and new stock plugs, was tested for emissions using the 2008 standards for the Ontario Drive Clean program, with the following results:

| | ASM 2525 TEST | | | CURB IDLE TEST | | |
|---|---|---|---|---|---|---|
| | Limit | Reading | Result | Limit | Reading | Result |
| HC ppm | 68 | 85 | FAIL | 200 | 135 | PASS |
| CO % | .38 | 0.62 | FAIL | 1 | .81 | PASS |
| NO ppm | 526 | 1054 | FAIL | N/A | N/A | N/A |
| | RPM | 2700 | VALID | RPM | 857 | VALID |
| | Dilution | 15.5 | VALID | Dilution | 15.4 | VALID |

Thereafter, the plugs were replaced with 100% plugs and the same tests were carried out:

| | ASM 2525 TEST | | | CURB IDLE TEST | | |
|---|---|---|---|---|---|---|
| | Limit | Reading | Result | Limit | Reading | Result |
| HC ppm | 68 | 9 | PASS | 200 | 9 | PASS |
| CO % | .38 | 0 | PASS | 1 | .11 | PASS |
| NO ppm | 526 | 17 | PASS | N/A | N/A | N/A |
| | RPM | 2700 | VALID | RPM | 1142 | VALID |
| | Dilution | 15.5 | VALID | Dilution | 15.3 | VALID |

Without intending to be bound by theory, it is believed that the configuration of the described plug creates an environment conductive to efficient ignition, which environment can be improved in the context of engines have relatively low compression by reducing the inlet area.

Thus, whereas only two specific embodiments are illustrated herein, it will be evident that the plug shown in FIG. 3 can be modified to provide greater and lesser amounts of restriction, i.e. R1:R2 can vary at least from 1:2 to 1:1.

Yet other variations are also possible without departing from the spirit and scope of the present invention.

For example, the central electrode can incorporate precious metals such as silver, gold and/or platinum.

As well, the outer shell could be made out of materials other than steel.

Additionally, the shapes and dimensions of the various components are also susceptible to variation.

Accordingly, the specification and the embodiment are to be considered exemplary only, and the invention should be understood as limited only by the accompanying claims, purposively construed.

The invention claimed is:

1. A spark plug comprising an insulator;

a central electrode extending through the insulator and having an ignition end;

an outer shell having a conducting end disposed about the insulator and a cylindrical grounding electrode end proximate to the ignition end of the central electrode; and a cavity constituted by a circular section defined by the grounding electrode end of the outer shell and extending into a cylinder head to which the spark plug is attachable, the inner wall of the cavity being sloped such that the cavity is bowl-shaped.

2. The spark plug of claim 1 wherein an inner wall of the cavity is sloped such that the cavity is bowl-shaped.

3. The spark plug of claim 1 wherein the conduit is orientated at the base of the inner wall.

4. An improved spark plug, of the type including a center electrode extending from an insulator tip and which extends into a piston chamber in use, the improvement comprising:

a shell:

defining a cavity;

defining a cavity opening which couples the cavity with said piston chamber in use;

defining a conduit extending from the cavity and into which the electrode extends in spaced relation to the shell, said cavity narrowing as the cavity extends toward the conduit; and in combination with the insulator tip, defining a chamber surrounding the insulator tip in spaced relation and coupled to the cavity by the conduit.

5. The improved spark plug according to claim 4, wherein the cavity includes a concave portion presenting towards the cavity opening such that the cavity narrows as the cavity extends towards the conduit.

6. The improved spark plug according to claim 5, wherein the cavity includes a substantially cylindrical portion extending from the concave portion towards the cavity opening.

7. The improved spark plug according to claim 4, wherein the cavity opening is frustoconical and flares outwardly as the cavity opening extends from the substantially cylindrical portion.

8. The improved spark plug according to claim 4, wherein the cavity opening is frustoconical and flares inwardly as the cavity opening extends from the substantially cylindrical portion.

9. The improved spark plug according to claim 8, wherein the shell has a frustoconical outer surface and the frustoconical outer surface of the shell and the cavity opening intersect in a knife-like edge.

10. The improved spark plug according to claim 4, wherein the chamber includes a substantially cylindrical portion surrounding the insulator tip in spaced relation and the chamber narrows as the chamber extends from the cylindrical portion thereof to the conduit.

11. The improved spark plug according to claim 4, wherein the chamber includes a substantially cylindrical portion surrounding the insulator tip in spaced relation and a frustoconical portion coupling the substantially cylindrical portion to the conduit such that the chamber narrows as the chamber extends from the cylindrical portion thereof to the conduit.

* * * * *